US007614263B2

(12) United States Patent
Kim et al.

(10) Patent No.: US 7,614,263 B2
(45) Date of Patent: Nov. 10, 2009

(54) DRUM WASHING MACHINE HAVING FOLDABLE DOOR

(75) Inventors: Dong Won Kim, Kwangmyung-si (KR); Young Il Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 665 days.

(21) Appl. No.: 11/247,206

(22) Filed: Oct. 12, 2005

(65) Prior Publication Data

US 2006/0086151 A1 Apr. 27, 2006

(30) Foreign Application Priority Data

Oct. 25, 2004 (KR) ..... 10-2004-0085421

(51) Int. Cl.
*D06F 37/28* (2006.01)
*D06F 39/14* (2006.01)

(52) U.S. Cl. ..... 68/196; 68/12.26; 68/140; 68/24; 68/58

(58) Field of Classification Search ..... 68/139, 68/196, 24, 147, 12.26, 58, 93, 140; 8/159
See application file for complete search history.

(56) References Cited

U.S. PATENT DOCUMENTS 2,351,656 A * 6/1944 Auten ..... 160/199
3,102,582 A * 9/1963 Rudnick ..... 160/206
3,623,785 A * 11/1971 Williams ..... 312/267
3,841,117 A * 10/1974 Crivilles ..... 68/20
4,911,325 A * 3/1990 De Giulio ..... 220/495.11

FOREIGN PATENT DOCUMENTS

| | | |
|---|---|---|
| EP | 1365056 | 11/2003 |
| JP | 2002-282583 | 10/2002 |
| KR | 1995-0000995 | 1/1995 |

OTHER PUBLICATIONS

U.S. Appl. No. 11/247,223 to Kim et al., which was filed Oct. 12, 2005.
U.S. Appl. No. 11/247,275 to Kim et al., which was filed Oct. 12, 2005.
U.S. Appl. No. 11/247,270 to Kim et al., which was filed Oct. 12, 2005.
U.S. Appl. No. 11/247,282 to Kim, which was filed Oct. 12, 2005.
U.S. Appl. No. 11/247,359 to Kim et al., which was filed Oct. 12, 2005.
English language Abstract of JP 2002-282583, Oct. 2, 2002.

* cited by examiner

*Primary Examiner*—Joseph L Perrin
*Assistant Examiner*—Benjamin Osterhout
(74) *Attorney, Agent, or Firm*—Birch, Stewart, Kolasch & Birch, LLP

(57) ABSTRACT

A drum washing machine having a foldable door includes a cabinet having an opening formed at a front wall of the cabinet, the foldable door provided at the front wall of the cabinet to open or close the opening, and which is separated into frames that fold when the foldable door is opened, and an opening/closing guide mechanism connected between the foldable door and the cabinet to guide the foldable door when the foldable door is being opened or closed.

7 Claims, 10 Drawing Sheets

DRUM WASHING MACHINE HAVING FOLDABLE DOOR

CROSS REFERENCE TO PRIORITY DOCUMENT

This application claims the benefit of priority to Korean Patent Application No. 2004-085421, filed in the Korean Patent Office on Oct. 25, 2004, and which is incorporated herein by reference in its entirety.

BACKGROUND OF THE INVENTION

1. Field of the Invention

The present invention relates to a door of a drum washing machine, and more particularly, to a drum washing machine having a foldable door, which can be folded when opening the door, and which can also be utilized as a laundry holder when the foldable door is opened 2. Description of the Related Art Referring to FIG. 1, for example, a conventional drum washing machine is illustrated which includes a cabinet 1, in which a tub and a drum are installed extending horizontally. An opening 3 is formed in a front wall of the cabinet 1 to communicate with the tub and drum. A related art door 5 is mounted to the cabinet 1 to open and close the opening 3.

The door 5 is hingably mounted, at one side thereof, to a portion of the cabinet 1 corresponding to one side of the opening 3 by a hinge mechanism 7. A handle (not shown) is provided at the other side of the door 5. In accordance with this structure, the door 5 is hingably movable when the user pulls the handle to open the opening 3 or pushes the handle to close the opening 3.

The door 5 includes an annular door rim 5*a*, and a door window 5*b* surrounded by the annular door rim 5*a*. The door window 5*b* is made of a transparent glass material, and has a convex structure protruding into the interior of the washing machine to come into contact with a gasket 9 mounted in the cabinet 1.

However, the above-mentioned conventional drum washing machine has a deficiency because the door 5 cannot be fully opened where the washing machine 1 is close to a wall W, as shown in FIG. 2, for example, because the door 5 is horizontally hingably opened. When the door 5 is partially opened, the convex door window 5*b* is positioned toward the opening 3, so that there may be an inconvenience because the convex door window 5*b* may interfere with laundry when the laundry is put into or removed from the washing machine 1 through the opening 3.

After completion of a laundry washing cycle, the user typically removes the laundry from the washing machine. In the process of removing the laundry from the washing machine, however, the user may drop the laundry to the floor because the laundry is in an entangled condition. Such a situation occurs frequently. In that case, there is an inconvenience because the dropped laundry must be washed again.

Also, the user typically takes the laundry, one item at a time, out of the washing machine, and shakes the laundry to separate foreign matter, such as lint or the like, which often clings to the laundry. After shaking one item of laundry, the user typically puts it into an additional laundry container (such as a separate laundry basket having no particular connection to the conventional washing machine, for example), and then shakes another item of laundry. The necessity of using the additional laundry container may cause inconvenience to the user when taking the laundry out of the washing machine, for example.

SUMMARY OF THE INVENTION

The present invention has been made in light of the above problems, among others, and it is an object of the present invention to provide a drum washing machine having a foldable door (hereinafter referred to as a "folding door"), which can be folded when opening the folding door by separating the folding door into upper and lower frames or into left and right frames, so that, even where the drum washing machine is located in a narrow space, the folding door of the drum washing machine can be easily opened and/or closed, and laundry can be conveniently put into and/or removed from the drum washing machine, thus enhancing the convenience of washing laundry or using the drum washing machine for a user.

In accordance with at least one aspect of the present invention, for example, a drum washing machine having a folding door may include a cabinet having an opening formed at a front wall of the cabinet, a folding door disposed at the front wall of the cabinet to open and/or close the opening and which is separated into at least two frames which may be folded when the folding door is opened and an opening/closing guide mechanism connected between the folding door and the cabinet to guide the folding door when the folding door is opened or closed.

The folding door may be separated into upper and lower frames, for example, such that the folding door can be folded while moving downwardly when opening folding the door.

Alternatively, the folding door may be separated into left and right frames, for example, such that the folding door can be folded while moving transversely when opening the folding door.

In addition, according to another aspect of the present invention, for example, a washing machine for washing at least one item may include a cabinet having an opening at a front wall of the cabinet, to allow the item to be put into or taken out of the cabinet, a folding door disposed at the front wall of the cabinet to open or close the opening of the cabinet, the folding door including frames which fold when the folding door is opening, and an opening/closing guide mechanism connected between the folding door and the cabinet, to guide the folding door when the folding door is opening or closing. Furthermore, the frames may include an upper frame and a lower frame, in which the folding door may be folded along a generally horizontal axis while moving downwardly when the folding door opens; or a left frame and a right frame, in which the folding door can be folded along a generally vertical axis while moving horizontally when the folding door opens.

Also, in the washing machine for washing the at least one item, the folding door may include a container in the upper frame to contain the item when the folding door is open. The opening/closing guide mechanism of the washing machine may further include a vertical guide mechanism to guide an upper end of the folding door vertically along an outer surface of a front cover of the cabinet, and door hinges to hingably connect a lower end of the lower frame to the cabinet.

According to another aspect of the present invention, for example, a folding door for opening or closing an opening at a front wall of a cabinet may include frames which fold when the folding door is opening, and an opening/closing guide mechanism connected between the folding door and the cabinet, to guide the folding door when the folding door is opening or closing. Furthermore, the frames may include an upper frame and a lower frame, in which the folding door may be folded along a generally horizontal axis while moving downwardly when the folding door opens; or a left frame and a right frame, in which the folding door can be folded along a generally vertical axis while moving horizontally when the folding door opens.

In addition, the folding door may include a container in the upper frame to contain an item to be removed from or placed into the cabinet when the folding door is open. The opening/closing guide mechanism of the folding door may further include a vertical guide mechanism to guide an upper end of the folding door vertically along an outer surface of a front cover of the cabinet, and door hinges to hingably connect a lower end of the lower frame to the cabinet.

In any of the aspects of the present invention noted above, although the washing machine or drum washing machine is exemplified to simplify discussion of certain features of the present invention, it should be understood that the present invention is not limited only to a washing machine for washing laundry, but also contemplates washing machines for washing any appropriate item, such as dishes and/or eating utensils, medical and/or scientific instruments (e.g., an autoclave), or any other item to be washed, for example. Further, the folding door may also function with any sort of cabinet or other such approximately cubic container (such as a filing cabinet, computer case, clothes dresser, or coal hopper, for example), and is not necessarily limited to use with washing machines or to laundry or other items to be washed, for example.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Preferred embodiments of the present invention will be described in detail with reference to the above-mentioned accompanying drawings.

Figure 1:
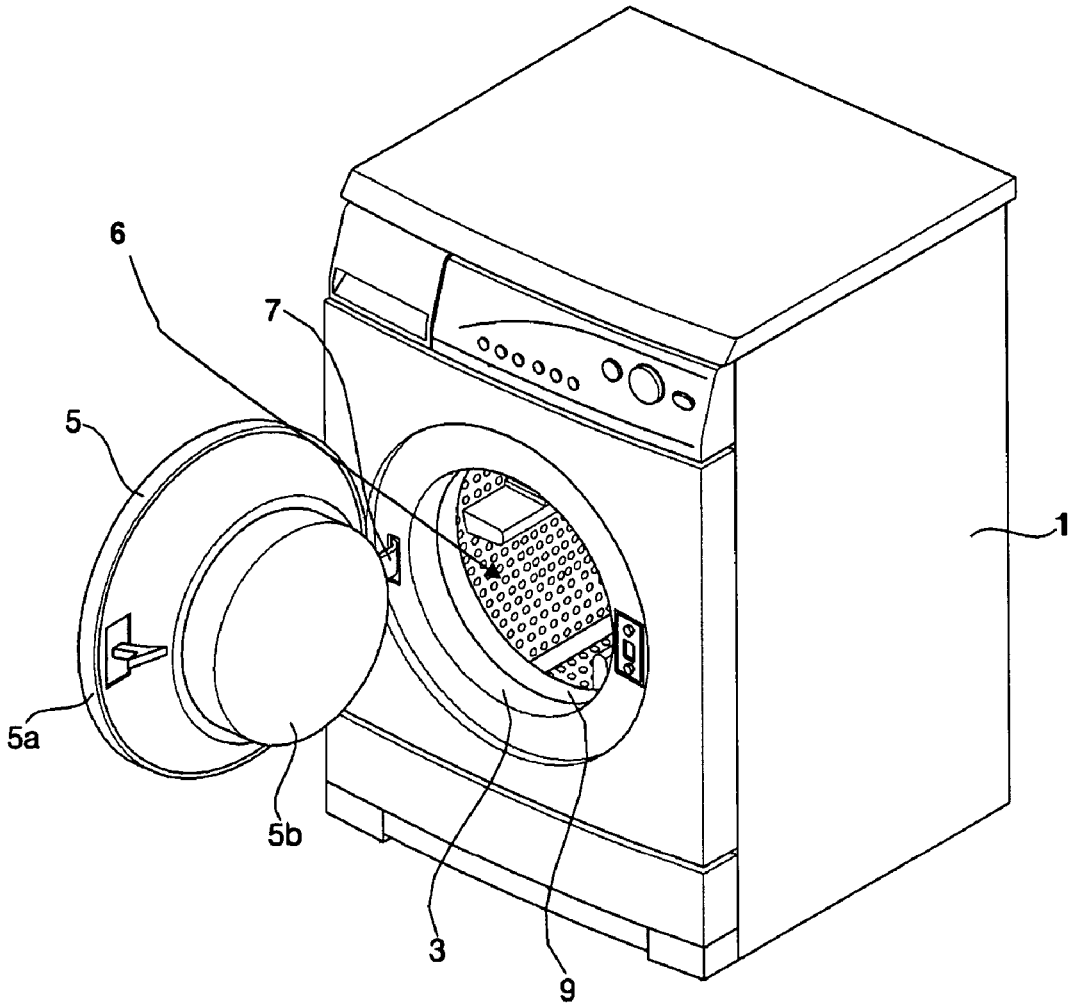
FIG. 1 (Prior Art)
FIG. 1 is a perspective view illustrating a conventional drum washing machine having a door.
Figure 2:
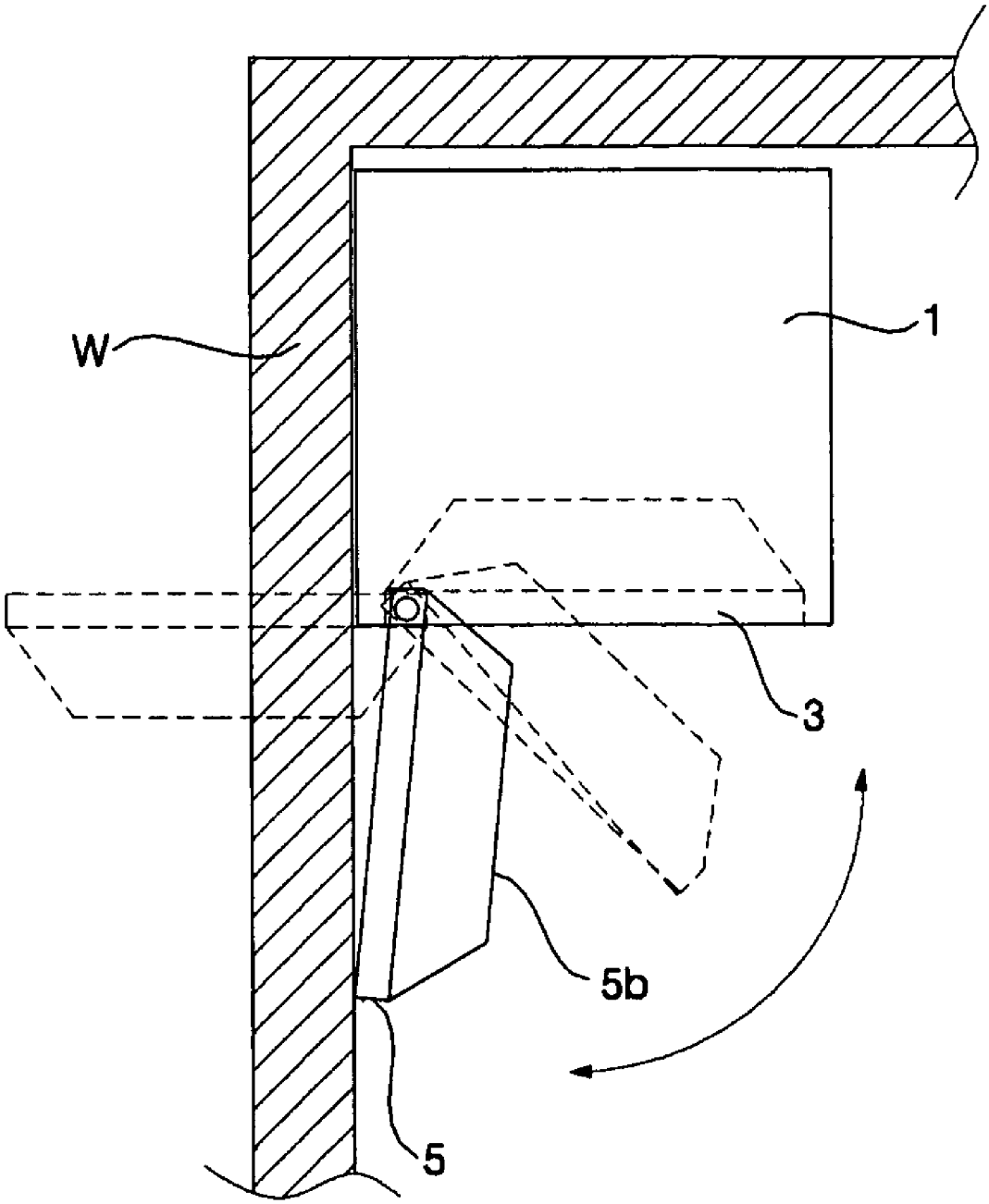
FIG. 2 (Prior Art)
FIG. 2 is a schematic view illustrating a door of the conventional drum washing machine when opened.
Figure 3:
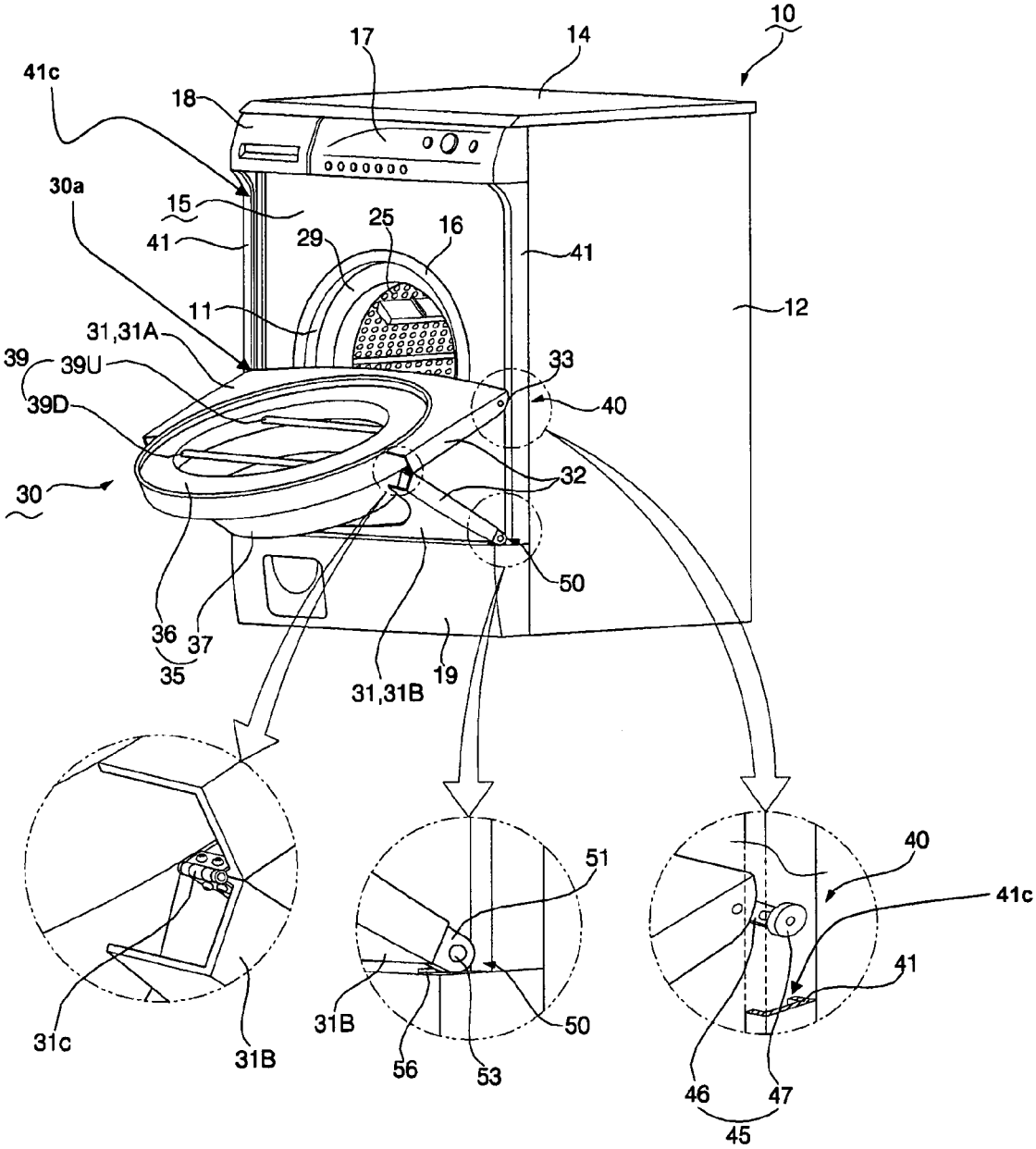
FIG. 3 is a perspective view illustrating a drum washing machine according to a first embodiment of the present invention, and includes enlarged detail views illustrating portions of a folding door of the drum washing machine.
Figure 4:
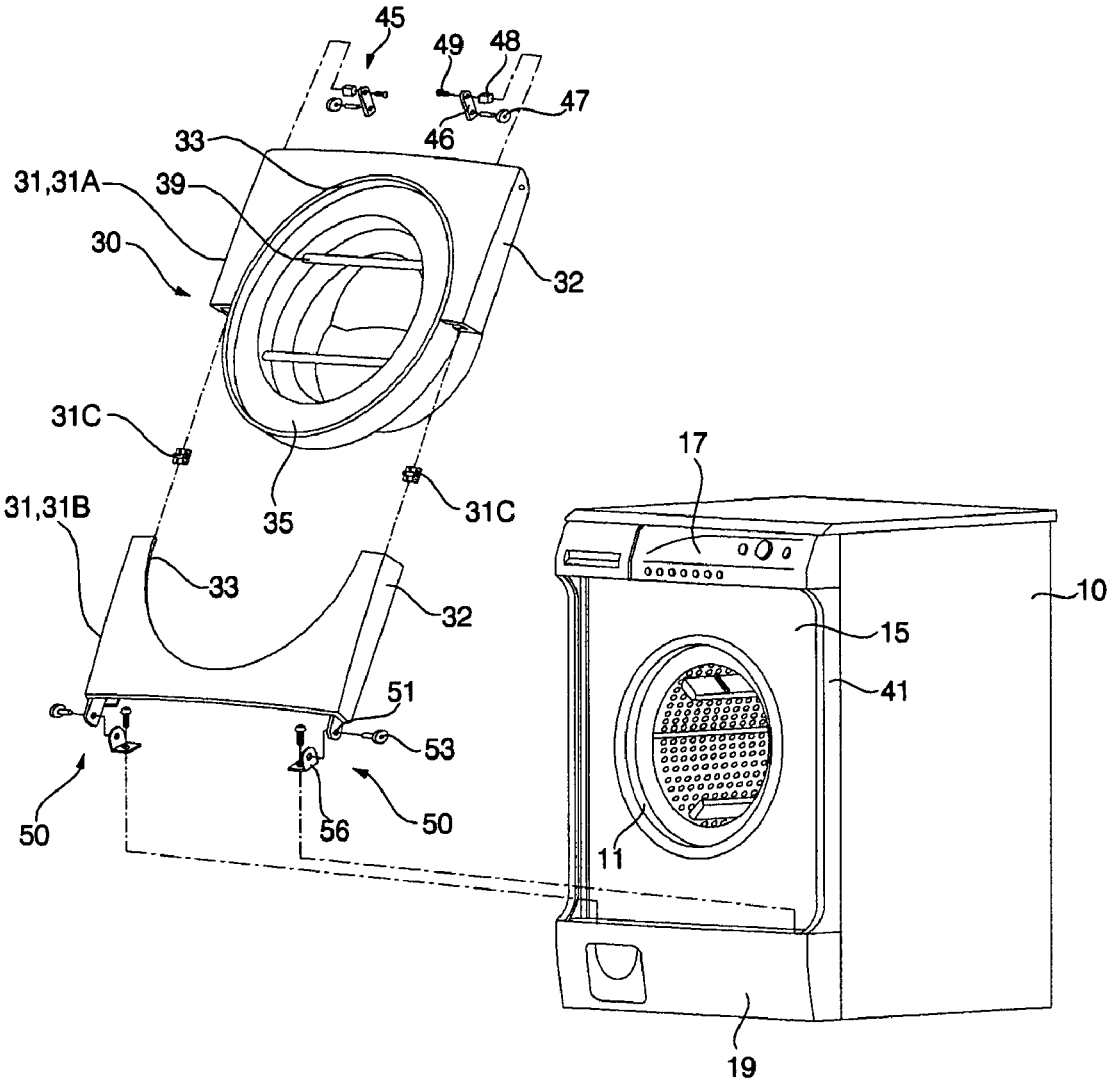
FIG. 4 is an exploded perspective view illustrating the drum washing machine according to the first embodiment of the present invention, in which the folding door of the drum washing machine is separated from the drum washing machine.
Figure 5:
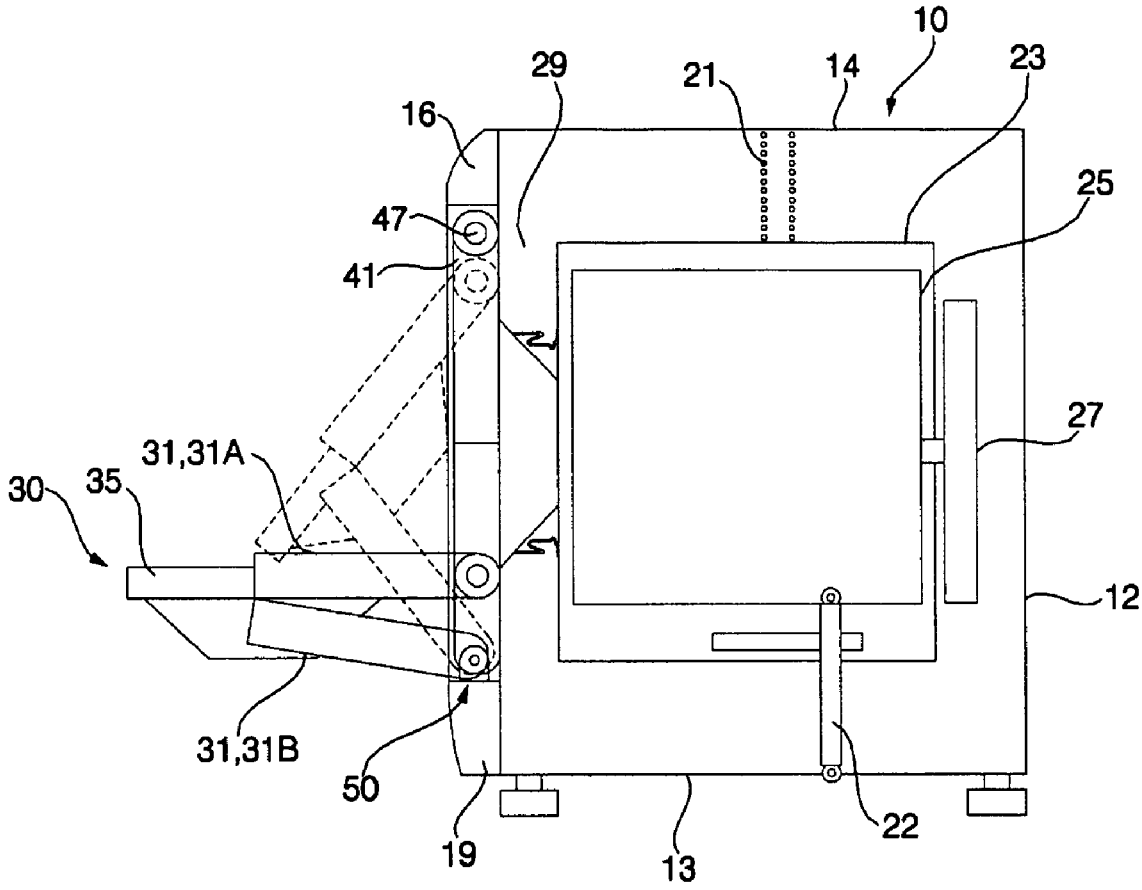
FIG. 5 is a schematic side view illustrating the drum washing machine according to the first embodiment of the present invention, in which the folding door is opened.

FIGS. 3 through 5 show a drum washing machine according to a first embodiment of the present invention, in which FIG. 3 illustrates the drum washing machine with a folding door 30, FIG. 4 illustrates the folding door 30 of the drum washing machine, and FIG. 5 illustrates the drum washing machine according to the first embodiment of the present invention with the folding door 30 fully opened, in profile view.

Referring to FIGS. 3 and 4, for example, the drum washing machine, which is provided with a folding door 30 in accordance with the first embodiment of the present invention, may include a cabinet 10 to form an outer structure of the drum washing machine. An opening 11 may be provided at a front wall of the cabinet 10 to allow laundry to be put into or removed from the drum washing machine.

Devices to perform a washing operation may be installed in the cabinet 10. For example, as shown in FIG. 3, the drum washing machine may include a tub 23 supported by a spring 21 and a damper 22 in the cabinet 10 to contain wash water, a drum 25 arranged in the tub 23 to wash laundry while rotating, and a drive motor 27 to rotate the drum 25.

The opening 11 of the cabinet 10 may communicate with respective openings of the tub 23 and the drum 25 to allow laundry to be put into or removed from the drum 25. A gasket 29 may be interposed between the openings of the cabinet 10 and tub 23 to prevent wash water or the like from penetrating the interior of the cabinet 10 during a washing process.

The cabinet 10 may have a generally hexahedral structure, among other possible configurations. For example, the cabinet 10 may include a cabinet body 12 to form side walls and a rear wall of the cabinet 10, a base 13 to form a bottom wall of the cabinet 10, a top cover 14 to form a top wall of the cabinet 10, and a front cover 15 to form a front wall of the cabinet 10. The opening 11 may be formed at the front cover 15.

A control panel 17 may be arranged on a top portion of the front cover 15, for example. The control panel 17 may include various operating switches and/or dials, or any other suitable control equipment operable by a user, to operate the drum washing machine, and a display device to display an operating state (or other salient information such as, for example, wash water temperature or the stage of the washing cycle) of the drum washing machine. Alternatively, the control panel 17 may be arranged at a position other than at the top portion of the front cover. For example, the control panel 17 may be arranged on the top wall of the cabinet 10, such as the top cover 14.

A slidable detergent box 18 to supply detergent may be arranged at one side of the control panel 17.

A lower cover 19 may be coupled to the cabinet body 12 and the base 13 to form a lower portion of the front cover 15.

Also, for example, a foldable (also referred to herein as "folding") door 30 may be provided on the front wall of the cabinet 10 to open and/or close the opening 11. As shown in FIG. 4, for example, the front cover 15 may be coupled to the cabinet body 12, the control panel 17, and the lower cover 19 while being recessed into the cabinet 10 with respect to the control panel 17 and the lower cover 19, such that, when the folding door 30 is closed, an outer surface 30*a* of the front door 15 is flush with outer surfaces of the lower cover 19 and the control panel 17 (see, for example, FIG. 6A).

An annular opening rim 16 may be provided at a central portion of the front cover 15 to define the opening 11. The gasket 29 can be fitted in the opening rim 16. The opening rim 16 may be formed integrally with the front cover 15 by bending a portion of the front cover 15 around the opening 11, for example. Alternatively, for example, the opening rim 16 may be a separate ring-shaped member which can be fitted around the opening 11.

Figure 6A:
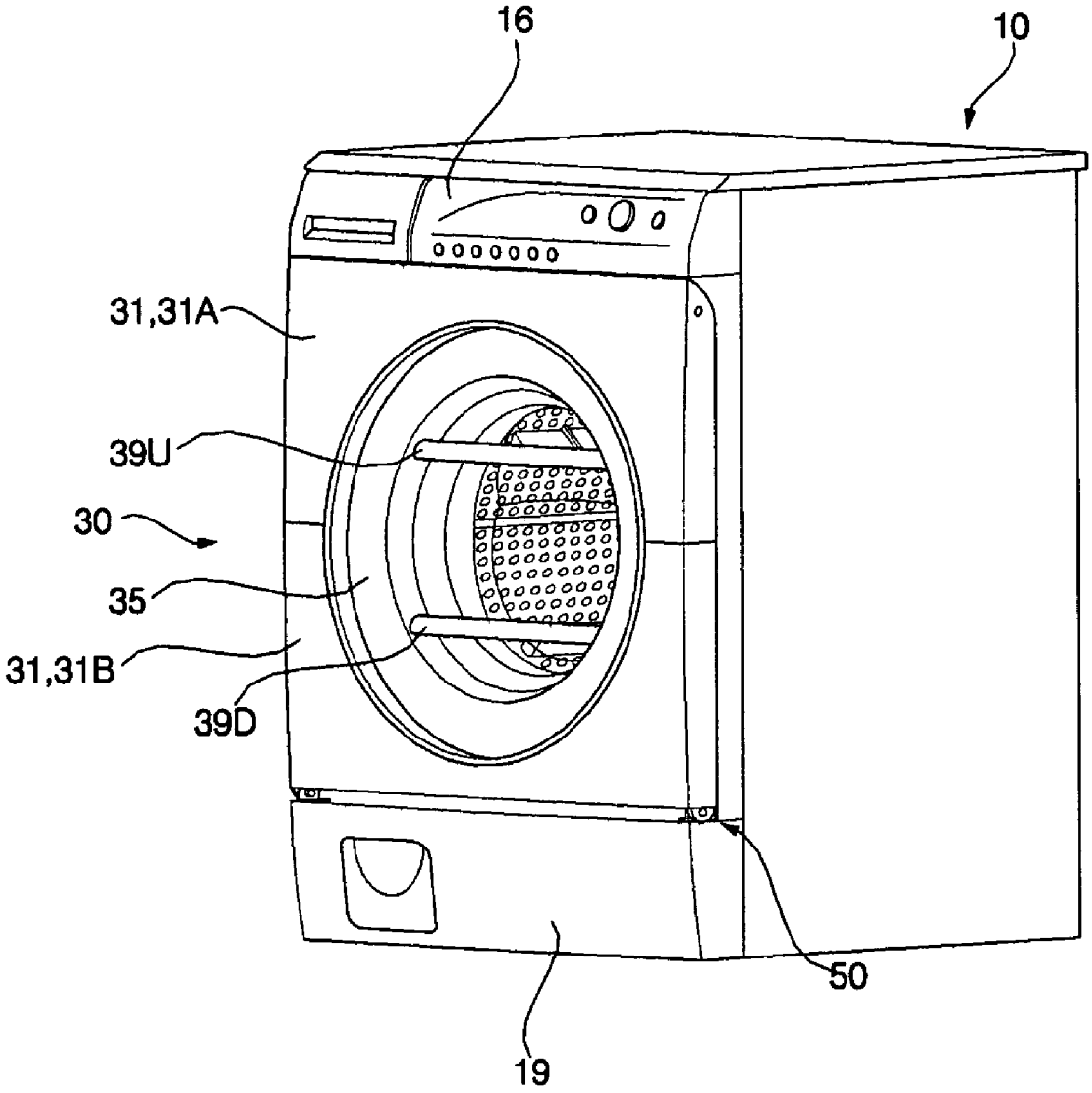
FIGS. 6A through 6C are perspective views illustrating a sequence of positions of the folding door of the drum washing machine according to the first embodiment of the present invention as the folding door is opened.

The folding door 30 may have a generally quadrangular shape similar to the shape of the front cover 15. As shown in FIGS. 4 and 6A, for example, the folding door 30 may have a generally quadrangular and/or planar structure, and may include a door frame 31 having a shape conforming to the shape of the outer surface of the front cover 15, and a container-shaped door window 35 having a convex structure which protrudes into the opening 11 of the cabinet 10 when the folding door 30 is closed, such that the container-shaped door window 35 comes into close contact with the gasket 29.

Further, for example, the door frame 31 may be separated into at least an upper frame 31A and a lower frame 31B with the container-shaped door window 35 provided between the upper frame 31A and the lower frame 31B. The upper and lower frames 31A and 31B may be connected to each other by, for example, foldable hinges 31C (for example, along a generally horizontal axis of the foldable hinges 31*c*), such that the upper and lower frames 31A and 31B can be moved downwardly, and then folded toward each other when the folding door 30 is opened.

Each of the upper and lower frames 31A and 31B may have opposite side portions 32 of the folding door 30 each formed by bending a corresponding side end portion of the door frames 31A and 31B into a shape generally similar to a letter "U", such that the side portions 32 form opposite side walls of the folding door 30, respectively. The upper and lower frames 31A and 31B may have the foldable hinges 31C installed at adjacent portions of the upper and lower frames 31A and 31B inside the opposite side portions 32 of the folding door 30, respectively.

A lower side of the upper frame 31A and an upper side of the lower frame 31B may be formed with semi-circular recesses 33, respectively, such that the container-shaped door window 35 can be installed within the semi-circular recesses 33. For example, the container-shaped door window 35 may be fixedly installed to the semi-circular recess 33 of the upper frame 31A, and the semi-circular recess 33 of the lower frame 31B may be separated from the semi-circular recess 33 of the upper frame 31A when the folding door 30 is opened.

The container-shaped door window 35 may include a laundry container to come into contact with the gasket 29 when the folding door 30 is closed, and to receive laundry when the folding door 30 is open. Referring to FIG. 5, for example, the door window 35 may include an annular window rim 36 mounted to the door frame 31, and a container-shaped window 37 having a concave container structure, which can hold laundry as a laundry container, to receive laundry. The container-shaped window 37 may be fitted in the window rim 36.

The window rim 36 may be made of a metal or synthetic resin material, for example, and the container-shaped window 37 may be made of a transparent or translucent material such as glass (or any other material of suitable strength and/or transparency, such as clear plastic or carbon fiber, for example) to allow the user to view the interior of the drum 25 through the container-shaped window 37.

One or more handles 39 may be provided at the folding door 30 to allow the user to open and/or close the folding door 30 while grasping the handle 39.

For example, the above-described folding door 30 can be opened such that an outer face 30*a* of the door window 35 faces upwardly (see FIG. 6C, for example) as the door frame 31 is folded. Accordingly, the folding door 30 can be opened with the door frame 31 folding, while moving to the lower side of the cabinet 10, and can be closed with the door frame 31 unfolding, while moving to the upper side of the cabinet 10.

For such an opening or closing operation of the folding door 30, an opening/closing guide mechanism may be arranged between the front cover 15 of the cabinet 10 and the folding door 30 at opposite sides of the folding door 30. The opening/closing guide mechanism may include a vertical guide mechanism to guide an upper end of the folding door 30 along the outer surface of the front cover 15 along a generally vertical path, and two door hinges 50 to hingably connect the lower end of the lower frame 31B to a lower portion of the cabinet 10 or to a lower portion of the front cover 15 of the cabinet 10.

The vertical guide mechanism 40 may include two vertical guides 41 mounted to opposite side ends of the outer surface of the front cover 15 extending vertically, respectively, and two pairs of guide couplers 45 each protruding from the upper frame 31A of the folding door 30 to move vertically along an associated one of the vertical guides 41, for example.

Each vertical guide 41 may be formed, at an inner surface thereof, with a "U"-shaped guide groove 41*c*. The vertical guides 41 may be provided in the form of separate members so that they may be mounted to the opposite side ends of the front cover 15, respectively. Alternatively, for example, the vertical guides 41 may be formed integrally with the front cover 15 by bending opposite side end portions of the front cover 15 into a shape generally similar to a letter "U", respectively.

It is preferable that each guide coupler 45 include a roller 47 to roll along the associated vertical guide 41. However, each guide coupler 45 may alternatively include a protrusion member (not shown), for example, which is slidably received in the associated vertical guide 41.

The rollers 47 may be rotatably mounted to roller brackets 46 mounted to the upper end of the door frame 31. Each roller bracket 46 may be connected to a mounting nut 48 fixed to an associated one of the side portions 32 of the door frame 31 by a bracket pin 49 such that the roller bracket 46 can be rotated within a roller angle. Accordingly, for example, when the folding door 30 moves along a vertical path, the roller bracket 46 may rotate about the bracket pin 49 within the roller angle, thereby enabling the associated roller 47 to move smoothly along the associated vertical guide 41.

Each of the door hinges 50 may include a supporting rod 51 attached to an inner surface of an associated side portion 32 of the lower frame 31B and extending below the lower end of the side portion 32, a hinge bracket 56 installed on an upper surface of the lower cover 19 to support the lower end of the supporting rod 51, and a hinge shaft 53 connecting the hinge bracket 56 and the supporting rod 51.

Although, as an exemplary structure, the lower frame 31*b* may be connected to the hinge brackets 56 by the supporting rods 51 (as illustrated in FIGS. 3 and 4), alternatively, for example, opposite lower ends of the lower frame 31B may be directly connected to the hinge brackets 56 by the hinge shafts 54 (as long as the implementation of the lower frame 31*b* is satisfied).

The handles 39 may be provided on the outer surface 30*a* of the folding door 30 in order to easily open or close the folding door 30. The handles 39 may be shaped similarly to an elongated rod, and may be horizontally installed to the window rim 36.

The handles 39 may preferably be installed to upper and lower portions of the folding door 30 about a portion where the upper frame 31A is connected to the lower frame 31B. Accordingly, when opening the folding door 30, the folding door 30 can be opened with a lower handle 39D, and when closing the folding door 30, the folding door 30 can be closed with an upper handle 39U, thereby allowing the folding door 30 to be easily opened and/or closed.

Although the handles 39 may be installed on the folding door 30 such that the handles 39 can be positioned above the container-shaped door window 35 (see FIG. 3, for example), alternatively, the handle 39 may otherwise be installed on alternative portions of the folding door 30 located above or below the positions described in the above-discussed example, respectively, such that the handles 39 protrude directly above the window rim 36, for example.

Examples of various modes of operation of the drum washing machine having the folding door 30 according to the first embodiment of the present invention are described below.

Figure 6B:
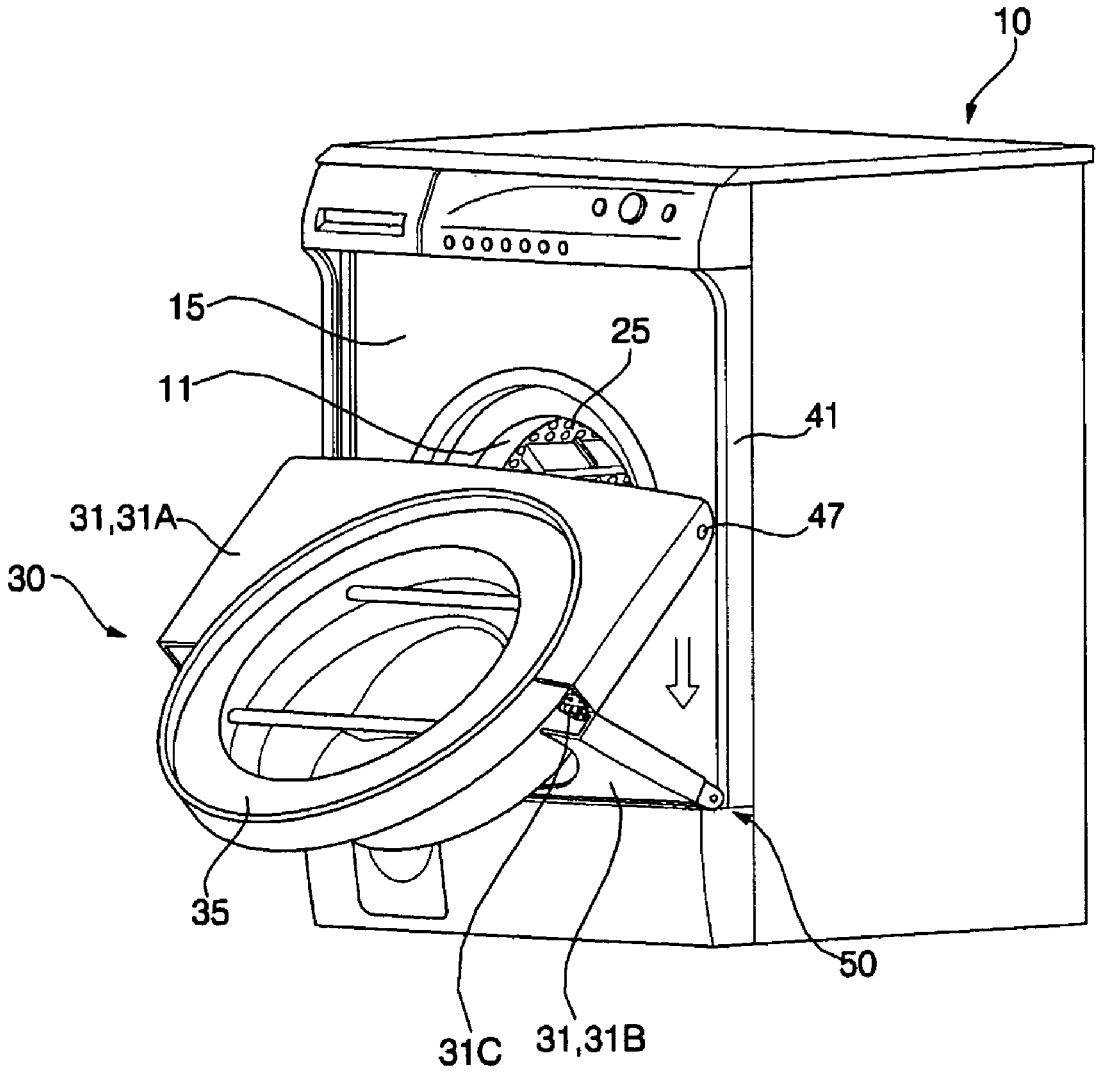
Figure 6C:
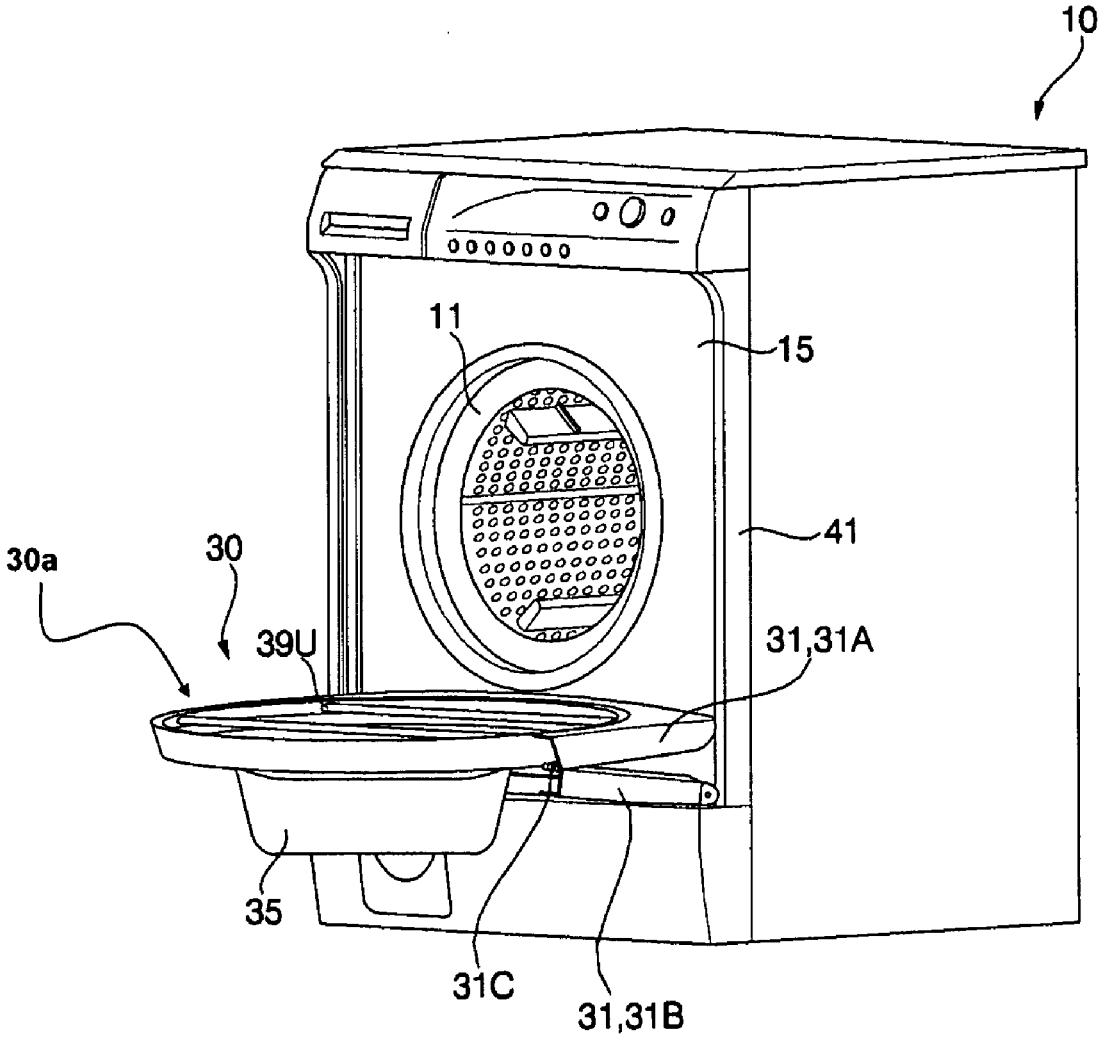

FIGS. 6A through 6C illustrate an opening sequence of the folding door 30 of the drum washing machine according to the first embodiment of the present invention, as the door is opened.

When the folding door 30 is urged downwardly by the lower handle 39D in order to open the folding door 30 from the closed state, as shown in FIG. 6A, for example, the upper frame 31A and the lower frame 31B are folded around the foldable hinges 31C while moving downwardly, along the course shown in FIG. 6B, for example, thereby allowing the folding door 30 to be completely opened as shown in FIG. 6C.

For example, when opening the folding door 30, the upper frame 31A and the lower frame 31B may be folded about the foldable hinges 31C while moving downwardly. The rollers 47 located at the upper end of the upper frame 31A may be moved downwardly along the vertical guides 41, and the lower frame 31B may be moved downwardly while rotating out from the front of the drum washing machine about the door hinges 50. Then, the container-shaped door window 35 fixed to the upper frame 31A may attain a generally horizontal orientation in the front of the drum washing machine along with the upper frame 31A.

As such, with the folding door 30 opened, laundry can be put into and/or removed from the drum 25 through the opening of the cabinet 10, and the laundry removed from the drum 25 can be contained in the container-shaped door window 35.

In order to close the folding door 30 from the opened state, the upper handle 39U of the folding door 30 may be pulled upwardly, and then the folding door 30 may be closed while moving upwardly.

For example, in reverse of the above-described procedure for opening the folding door 30, the upper frame 31A and the lower frame 31B may be unfolded about the foldable hinges 31C while moving upwardly. The rollers 47 located at the upper end of the upper frame 31A may be moved upwardly along the vertical guides 41, and the lower end of the door 30 may rotate about the door hinges 50, thereby allowing the folding door 30 to be closed while coming into close contact with the front cover 15.

Figure 7:
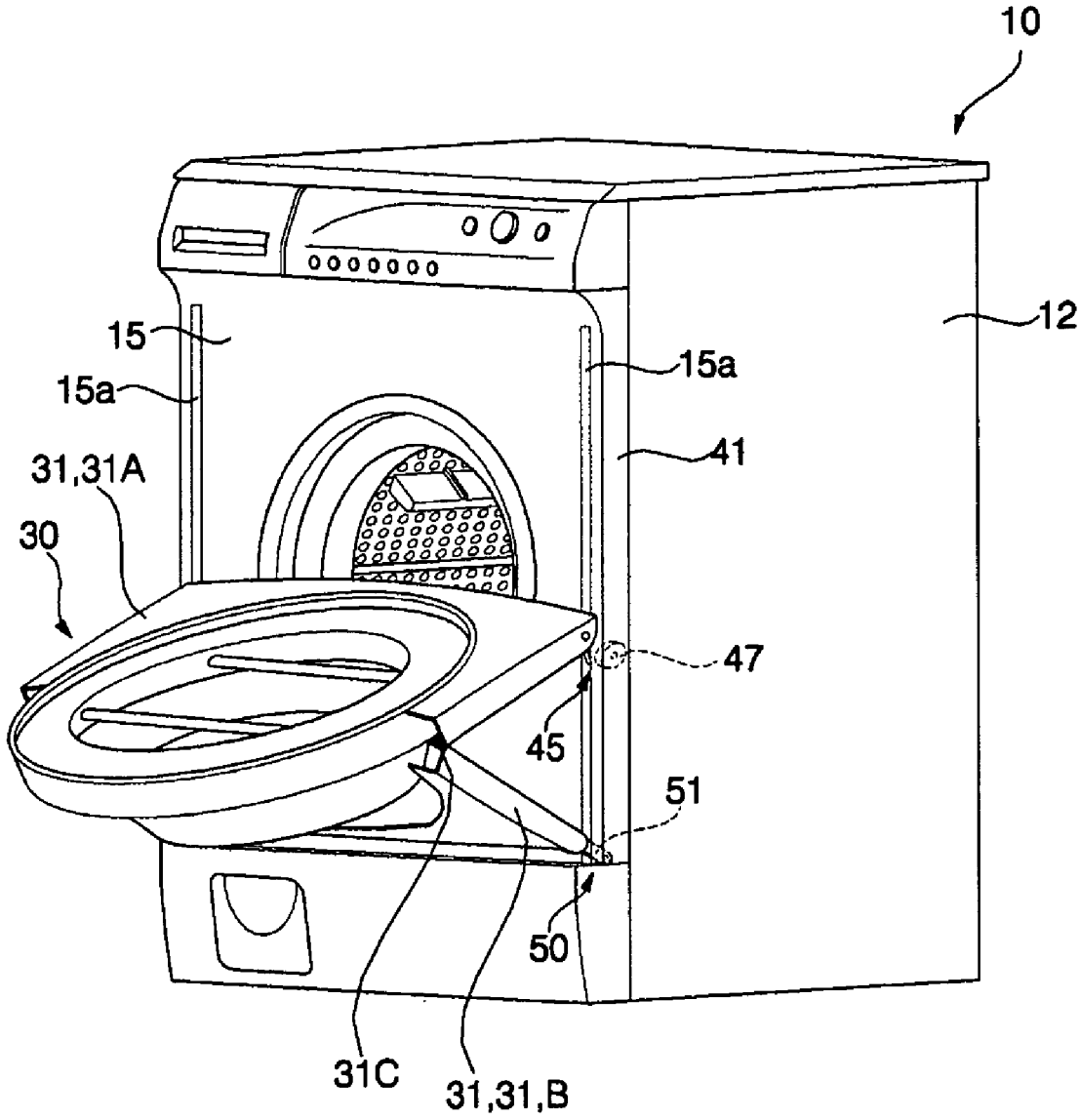
FIG. 7 is a perspective view illustrating a drum washing machine according to a second embodiment of the present invention.

FIG. 7 illustrates an example of a drum washing machine according to a second embodiment of the present invention in which a folding door 30 may have (for example) two pairs of guide couplers, which can be inserted into a front cover 15, and moved vertically along vertical guides 41.

For example, a front cover 15 may have longitudinally elongated slits 15*a* formed at opposite sides of the front cover 15 such that the guide couplers 45 are inserted into the slits 15*a*, and then moved within the slits 15*a*, respectively. The vertical guides 41 may be provided inside the slits 15*a*, respectively. Also, as with the above described first embodiment, for example, the folding door 30 of the second embodiment may have roller brackets (not shown) inserted into the slits 15*a* to move vertically along the vertical guides 41, and rollers 47 mounted to the roller brackets 47.

Except for the above-mentioned and/or other specifically noted features discussed in relation to the second embodiment, the second embodiment of the invention may include features generally similar to the first embodiment of the present invention (or any other suitable embodiment), for example.

As described above, in the drum washing machine according to the second embodiment of the invention, for example, when opening or closing the folding door 30, the upper and lower frames 31A and 31B may be folded or unfolded about the foldable hinges 31C. At that time, the upper frame 31A may be moved vertically along the vertical guides 41 and the lower frame 31B may be rotated about the door hinges 50, so that the folding door 30 can be opened or closed along a generally vertical path.

Figure 8:
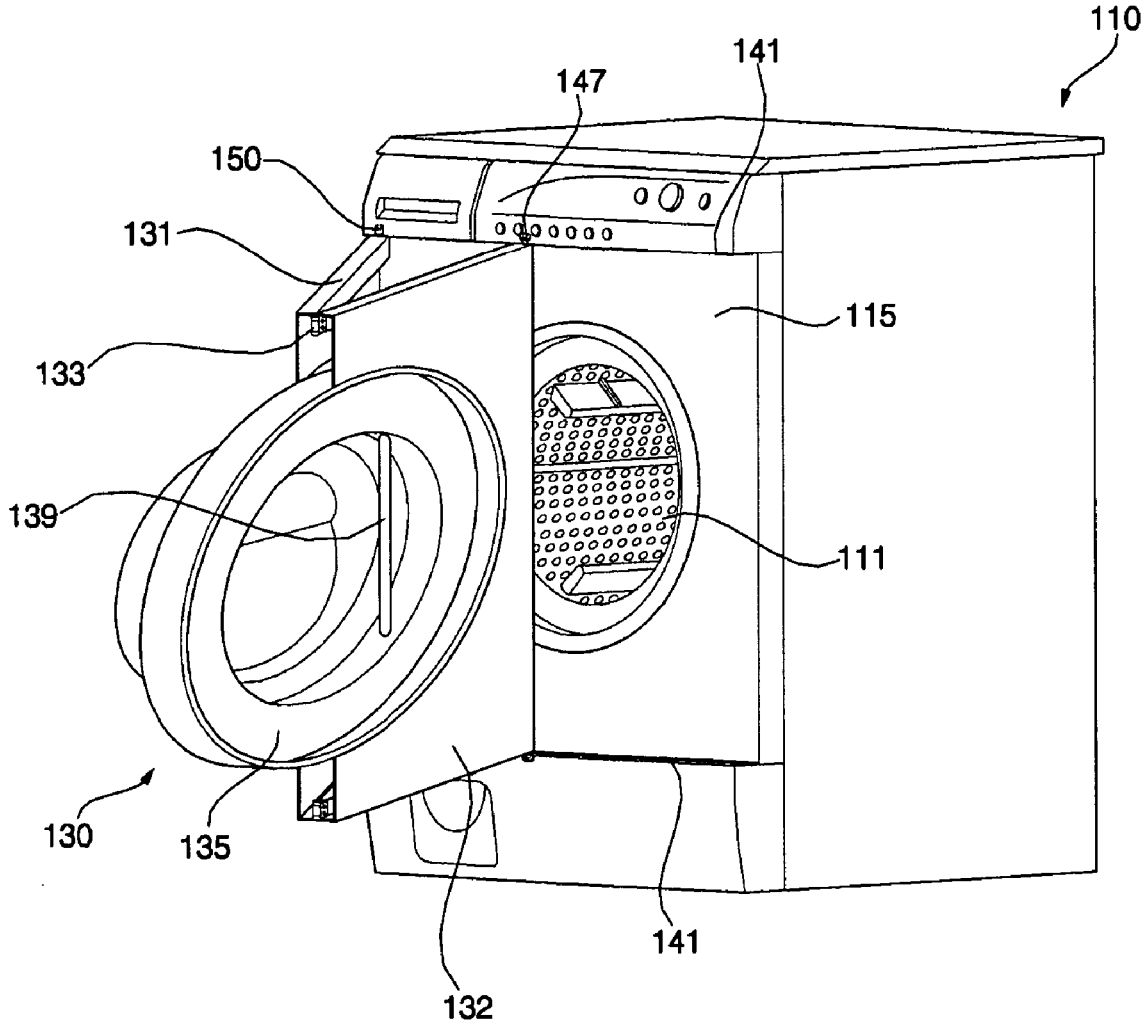
FIG. 8 is a perspective view illustrating a drum washing machine according to a third embodiment of the present invention.

FIG. 8 illustrates an example of a drum washing machine according to a third embodiment of the present invention, in which a folding door 130 is opened while being folded transversely (sideways).

For example, a door frame of the folding door 130 may be separated into a left frame 131 and a right frame 132 with foldable hinges 133 installed between the left frame 131 and the right frame 132, so that the folding door 130 can be opened as the left frame 131 and the right frame 132 are folded.

Furthermore, the right frame 132 may include rollers 147, for example, such that the rollers 147 can be moved horizontally along horizontal guides 141 installed to upper and lower sides of a front cover 115, and the left frame 131 may be hingably installed to the folding door 130 by door hinges 150. A door window 135 located at the center of the folding door 130 may be fixedly installed to the right frame 132.

The foldable door structure of the third embodiment of the present invention may include features generally similar to the above-described first and second embodiments (or any other suitable embodiments), for example, except that the folding door 130 of the drum washing machine may be transversely opened or closed. Accordingly, in the drum washing machine according to the third embodiment of the present invention, the folding door 130 may be opened by pushing a door handle 139 to the left, and closed by pushing the door handle 139 to the right.

Also, although the folding door 130 may open to the left as an example, as shown in FIG. 8, alternatively, the folding door 130 may instead open to the right, as long as the implementation of the door 130 is satisfied, for example. As a further alternative, without fixing one side of the folding door 130 to the cabinet 110 by the door hinge 150, the rollers and the hinges may be provided to both the left frame and the right frame, such that the folding door 130 can be opened and/or closed toward either the left or the right, for example.

As apparent from the above description, in a drum washing machine having a folding door according to the present invention, the folding door can be opened while being folded due to the separation of the folding door into upper and lower frames or into left and right frames, for example, so that even where the drum washing machine is located in a narrow space, the folding door can be relatively easily opened and/or closed, and laundry can be conveniently put into or removed from the drum washing machine, in order to enhance the convenience of using the drum washing machine for a user.

For example, when the folding door is separated into the upper and lower frames, because the folding door can be opened with the container-shaped door window facing upwardly, laundry can be conveniently contained within the door window, and prevented from being dropped to the floor when removing the laundry from the drum of the drum washing machine, thereby facilitating putting laundry into or removing laundry from the drum washing machine.

Although several embodiments and examples of the present invention have been disclosed and described for illustrative purposes, those skilled in the art will appreciate that various modifications, additions, and/or substitutions thereto are possible, without departing from the spirit of the present invention, the scope of which is set forth in the accompanying claims.

What is claimed is:

1. A drum washing machine, comprising:

a cabinet having an opening at a front wall of the cabinet;

a folding door disposed at the front wall of the cabinet to open or close the opening, and separated into a plurality of frames configured to fold when the door is opened; and an opening/closing guide mechanism connected between the folding door and the cabinet, configured to guide the folding door when the folding door is being opened or closed, wherein the plurality of frames of the folding door include an upper frame and a lower frame connected to each other by at least one foldable hinge, and a door window disposed on the upper frame, wherein the folding door can be folded along a generally horizontal axis while moving downwardly when opening the folding door, and wherein the door window is container-shaped and has a convex structure configured to protrude into the opening of the cabinet.

2. The drum washing machine according to claim 1, wherein the folding door includes a laundry container in the upper frame of the folding door and configured to contain laundry when the folding door is open.

3. The drum washing machine according to claim 1, wherein the door window has a generally circular shape, wherein a plurality of generally and semi-circular recesses are formed at a lower side of the upper frame and an upper side of the lower frame, respectively, and wherein the door window is installed to the semi-circular recesses of the upper frame.

4. The drum washing machine according to claim 1, wherein the opening/closing guide mechanism includes a vertical guide mechanism configured to guide an upper end of the folding door vertically along an outer surface of a front cover of the cabinet, and a plurality of door hinges configured to hingably connect a lower end of the lower frame to the cabinet.

5. The drum washing machine according to claim 4, wherein the vertical guide mechanism includes at least first and second vertical guides respectively mounted to first and second opposite side ends of the cabinet extending generally vertically, and at least first and second pairs of guide couplers, each protruding from an associated side portion of the folding door and configured to move vertically along an associated one of the first or second vertical guides.

6. The drum washing machine according to claim 5, wherein each of the guide couplers includes a roller configured to move rollingly along the associated one of the first or second vertical guides.

7. A drum washing machine, comprising:

a cabinet having an opening at a front wall of the cabinet;

a folding door disposed at the front wall of the cabinet to open or close the opening, and separated into a plurality of frames configured to fold when the door is opened; and an opening/closing guide mechanism connected between the folding door and the cabinet, configured to guide the folding door when the folding door is being opened or closed, wherein the plurality of frames of the folding door include an upper frame and a lower frame connected to each other by at least one foldable hinge, and a door window disposed on the upper frame, wherein the folding door can be folded along a generally horizontal axis while moving downwardly when opening the folding door, wherein the opening/closing guide mechanism includes a vertical guide mechanism configured to guide an upper end of the folding door vertically along an outer surface of a front cover of the cabinet, and a plurality of door hinges configured to hingably connect a lower end of the lower frame to the cabinet, and wherein each of the door hinges includes a supporting rod extending generally vertically from a lower end of the folding door.

* * * * *